US005465431A

United States Patent [19]

Wertz

[11] Patent Number: 5,465,431

[45] Date of Patent: Nov. 14, 1995

[54] BOY'S URINAL TRAINER FOR A TOILET

[76] Inventor: Carl F. Wertz, 231 Tall Pines Rd., Ladson, S.C. 29456-3106

[21] Appl. No.: 299,522

[22] Filed: Sep. 1, 1994

[51] Int. Cl.[6] ..... E03D 9/00

[52] U.S. Cl. ..... 4/300.3; 4/902

[58] Field of Search ..... 4/300.3, 340, 341, 4/342, 661, 902, 310, DIG. 5

[56] References Cited

U.S. PATENT DOCUMENTS

| | | | |
|---|---|---|---|
| 2,147,588 | 2/1939 | Zinkil et al. | 4/310 |
| 2,791,780 | 5/1957 | Krischner | 4/DIG. 5 X |
| 2,980,919 | 4/1961 | Otto et al. | 4/300.3 |
| 3,071,778 | 1/1963 | Renshaw | 4/300.3 |
| 3,500,480 | 3/1970 | Michal | 4/341 X |

*Primary Examiner*—Charles E. Phillips

[57] ABSTRACT

A boy's urinal trainer comprising a tubular seat having a top end, a bottom end with a lip formed thereon, a peripheral side wall interconnecting the top end with the bottom end, an integral rim extended downwards from the bottom end, and a cut out formed through the side wall and with the lip positionable upon a top edge of a bowl of a toilet with the rim extended therein for holding the seat in a fixed configuration, the cut out receiving a boy's urine stream directed towards the bowl, and the side wall in combination with the rim used for properly directing a boy's urine downwards to the bowl for collection.

1 Claim, 4 Drawing Sheets

BOY'S URINAL TRAINER FOR A TOILET

BACKGROUND OF THE INVENTION

1. Field of the Invention

The present invention relates to a boy's urinal trainer for a toilet and more particularly pertains to training a boy to urinate into a bowl of a toilet with a boy's urinal trainer for a toilet.

2. Description of the Prior Art

The use of toilet urinals is known in the prior art. More specifically, toilet urinals heretofore devised and utilized for the purpose of allowing a user to urinate into a toilet are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,500,480 to Michal Jr. discloses a urinal attachment for toilet bowl. U.S. Pat. No. 4,612,676 to Whitman discloses a urinal attachment for toilet. U.S. Pat. No. 4,932,083 to Arozena discloses an inset urinal compartment for toilet bowls. U.S. Pat. No. 5,148,553 to Jermann discloses a child's urinal for hanging on side of toilet. U.S. Pat. No. 5,153,947 to Markles discloses a urinal attachment to a toilet.

While these devices fulfill their respective, particular objective and requirements, the aforementioned patents do not describe a boy's urinal trainer for a toilet that allows a boy's urine stream to be properly directed toward a bowl and a toilet and further allows rinsing thereof when the toilet is flushed.

In this respect, the boy's urinal trainer for a toilet according to the present invention substantially departs from the conventional concepts and designs of the prior art, and in doing so provides an apparatus primarily developed for the purpose of training a boy to urinate into a bowl of a toilet.

Therefore, it can be appreciated that there exists a continuing need for new and improved boy's urinal trainer for a toilet which can be used for training a boy to urinate into a bowl of a toilet. In this regard, the present invention substantially fulfills this need.

SUMMARY OF THE INVENTION

In the view of the foregoing disadvantages inherent in the known types of toilet urinals now present in the prior art, the present invention provides an improved boy's urinal trainer for a toilet. As such, the general purpose of the present invention, which will be described subsequently in greater detail, is to provide a new and improved boy's urinal trainer for a toilet and method which has all the advantages of the prior art and none of the disadvantages.

To attain this, the present invention essentially comprises, in combination, a tubular plastic seat having a top end with an inwardly extended brim formed thereon, a bottom end with an outwardly extended and curved radial lip formed thereon, a peripheral vertical side wall interconnecting the top end with the bottom end, an annular integral rim extended downwards from the bottom end, a U-shaped cut out formed through the side wall and brim, a generally U-shaped channel formed within the brim and extended from a location near one side of the cut out to an opposite location on the other side of the cut out, and a plurality of outlets extended downwards from the channel with each outlet terminated at an opening near the side wall. The lip is positionable upon a top edge of a bowl of a toilet with the rim extended therein for holding the seat in a fixed configuration. The cut out receives a boy's urine stream directed towards the bowl of a toilet. The side wall in combination with the rim properly directs a boy's urine downwards to the bowl for collection. A plastic tube is included and has a first end extended through the brim and positioned in the channel for communication therewith and a second end adapted to be connected to a water line of a toilet. The tube is adapted for delivering water to the channel for allowing rinsing of the side wall through the outlets when the toilet is flushed. Lastly, a clamp is coupled to the tube and has one orientation for preventing water from being delivered to the seat and another orientation for allowing such delivery to occur.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved boy's urinal trainer for a toilet which has all the advantages of the prior art toilet urinals and none of the disadvantages.

It is another object of the present invention to provide a new and improved boy's urinal trainer for a toilet which may be easily and efficiently manufactured and marketed.

It is a further object of the present invention to provide a new and improved boy's urinal trainer for a toilet which is of durable and reliable construction.

An even further object of the present invention is to provide a new and improved boy's urinal trainer for a toilet which is susceptible of a low cost of manufacture with regard to both materials and labor, and which accordingly is then susceptible of low prices of sale to the consuming public, thereby making such a boy's urinal trainer for a toilet economically available to the buying public.

Still yet another object of the present invention is to provide a new and improved boy's urinal trainer for a toilet which provides in the apparatuses and methods of the prior art some of the advantages thereof, while simultaneously overcoming some of the disadvantages normally associated therewith.

Even still another object of the present invention is to provide a new and improved boy's urinal trainer for a toilet for training a boy to urinate into a bowl of a toilet.

Lastly, it is an object of the present invention to provide a new and improved boy's urinal trainer for a toilet comprising a tubular seat having a top end, a bottom end with a lip formed thereon, a peripheral side wall interconnecting the top end with the bottom end, an integral rim extended downwards from the bottom end, and a cut out formed through the side wall and with the lip positionable upon a top edge of a bowl of a toilet with the rim extended therein for holding the seat in a fixed configuration, the cut out receiving a boy's urine stream directed towards the bowl, and the side wall in combination with the rim used for properly directing a boy's urine downwards to the bowl for collection.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
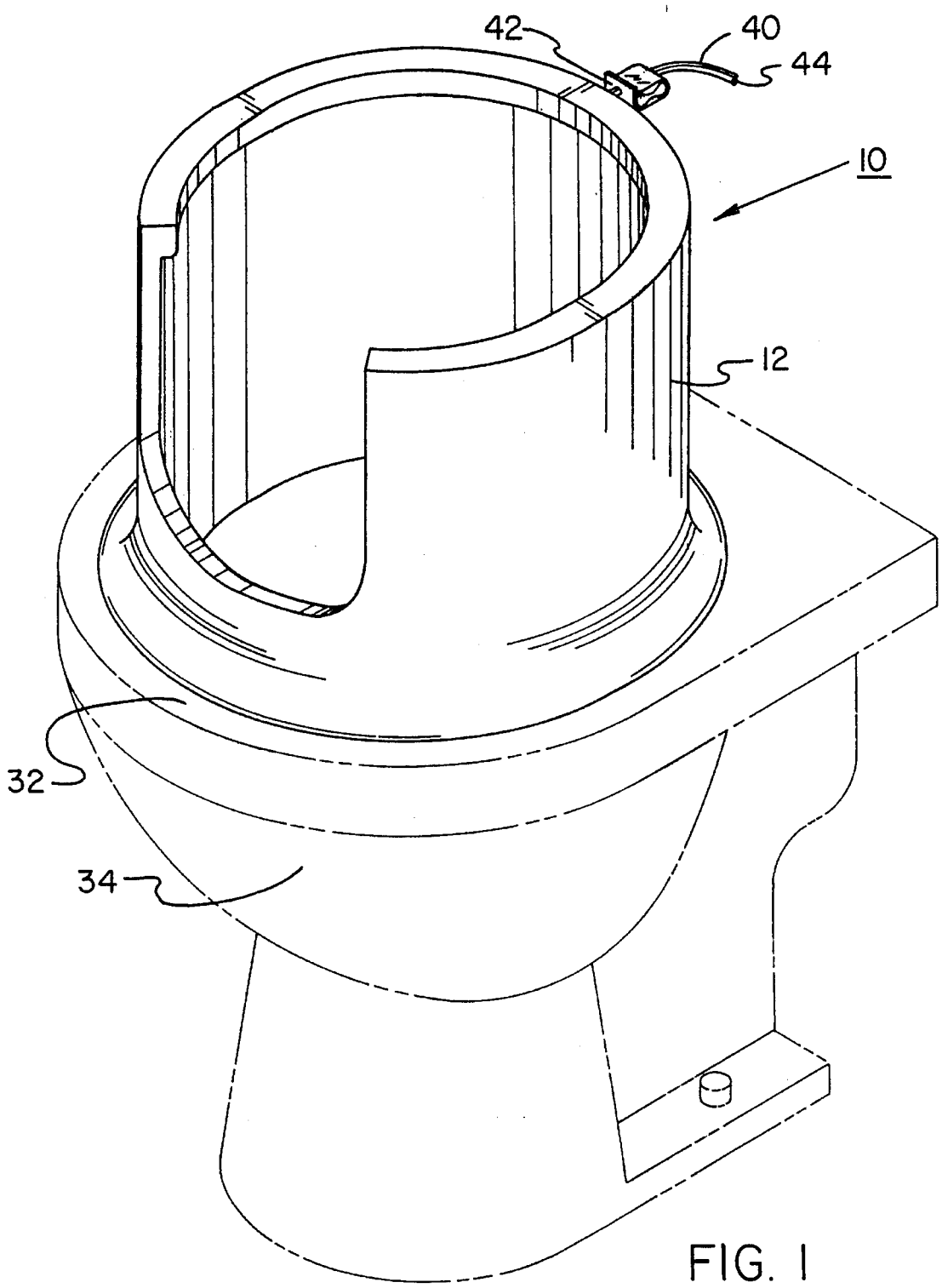
FIG. 1 is a perspective view of the preferred embodiment of the boy's urinal trainer for a toilet constructed in accordance with the principles of the present invention secured to a bowl of a toilet.
Figure 2:
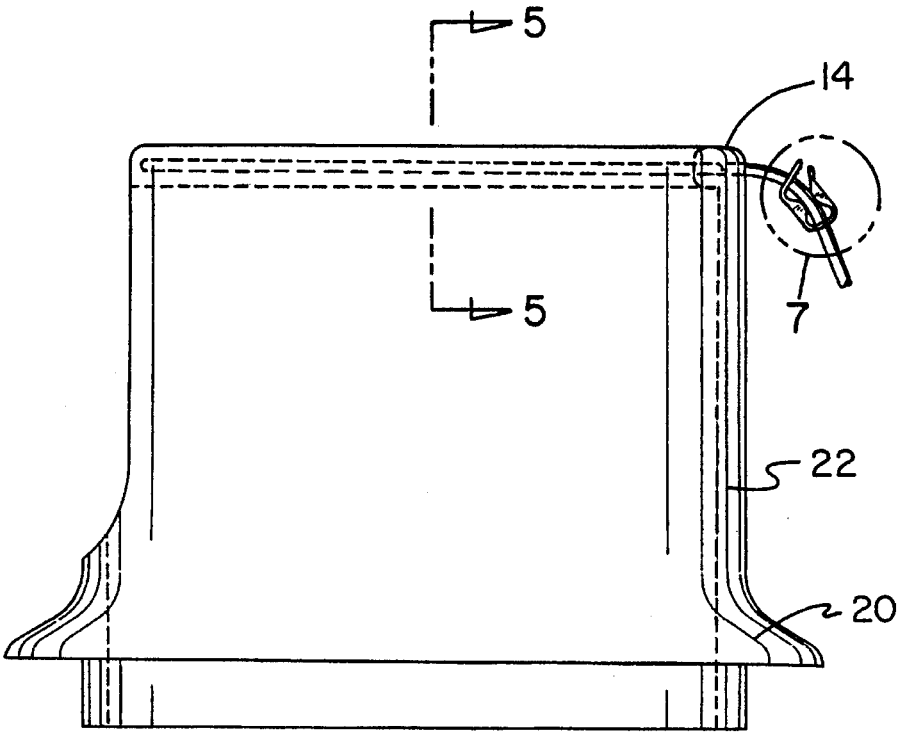
FIG. 2 is a side-elevational view of the present invention.
Figure 3:
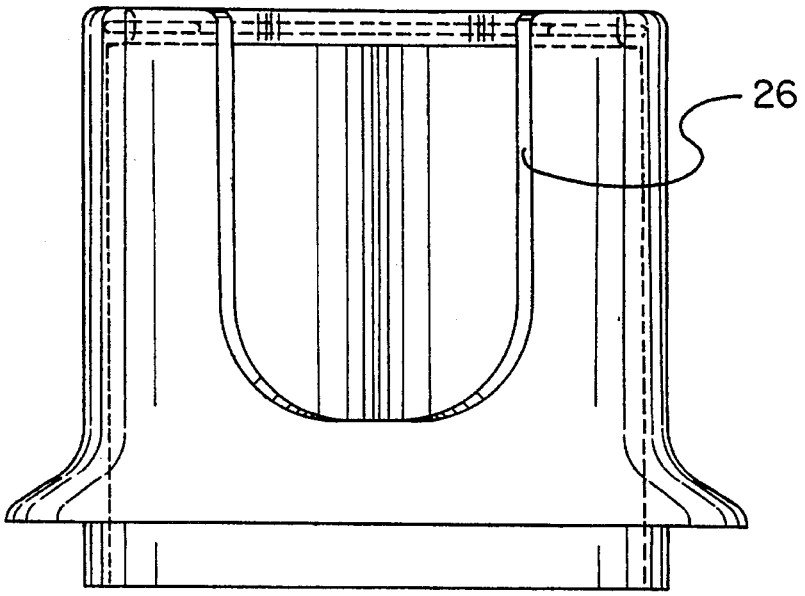
FIG. 3 is yet another side-elevational view of the present invention depicting the cut out through the seat.
Figure 4:
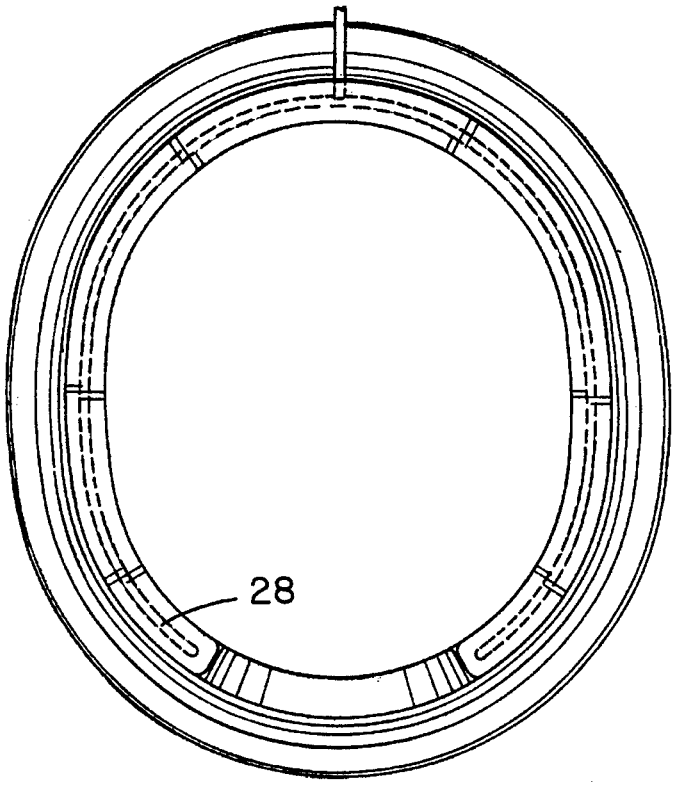
FIG. 4 is a plan view of the present invention depicting the positioning of the channel and outlets within the brim of the seat.
Figure 5:
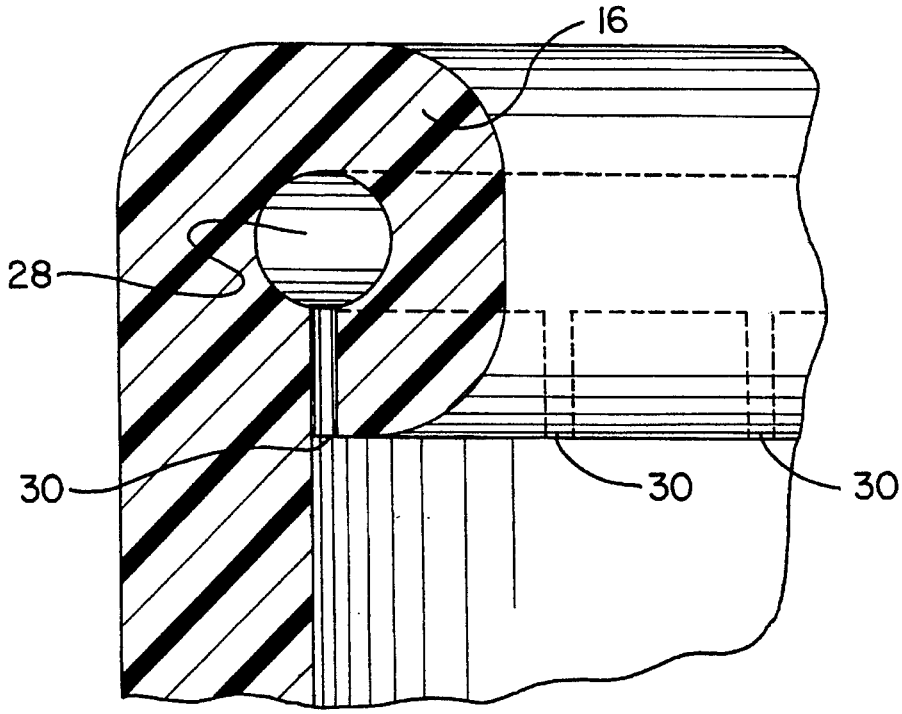
FIG. 5 is a cross-sectional view of the present invention taken along the line 5—5 of FIG. 2.
Figure 6:
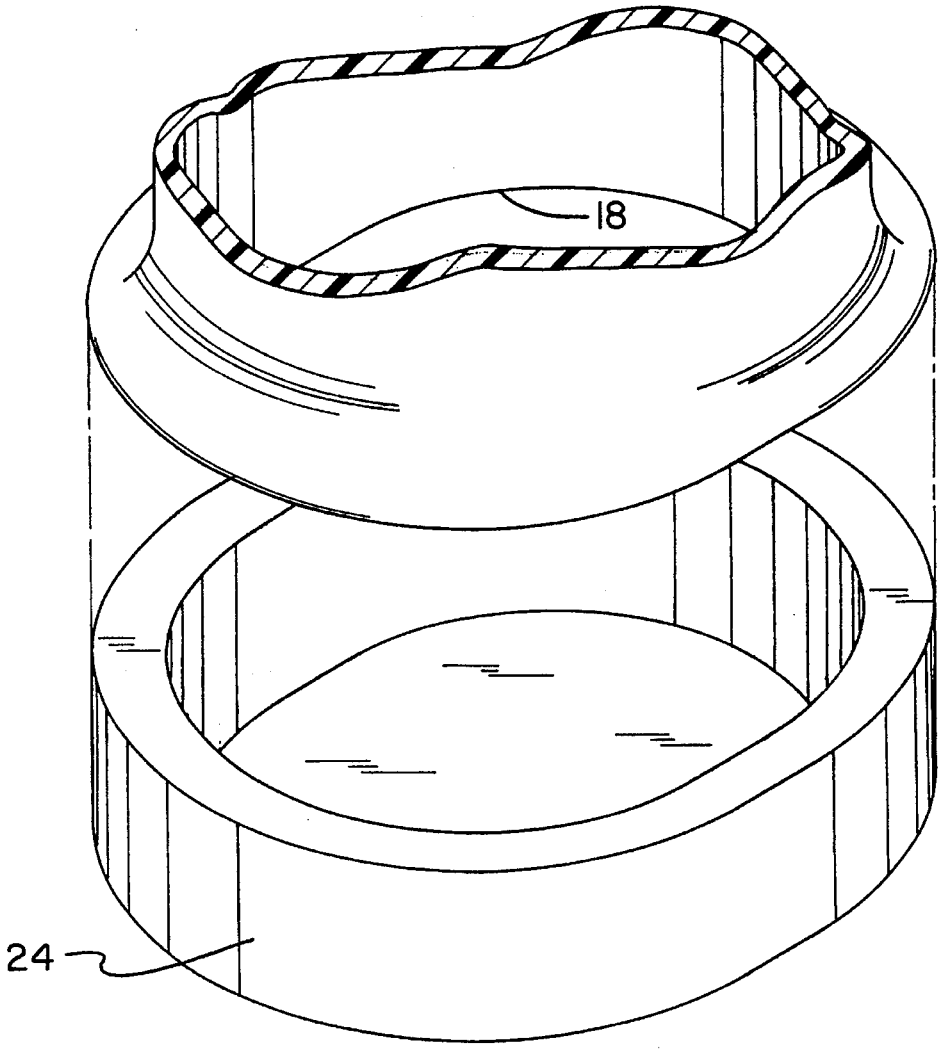
FIG. 6 is an exploded perspective view of the rim of the toilet seat and lip thereabove.
Figure 7:
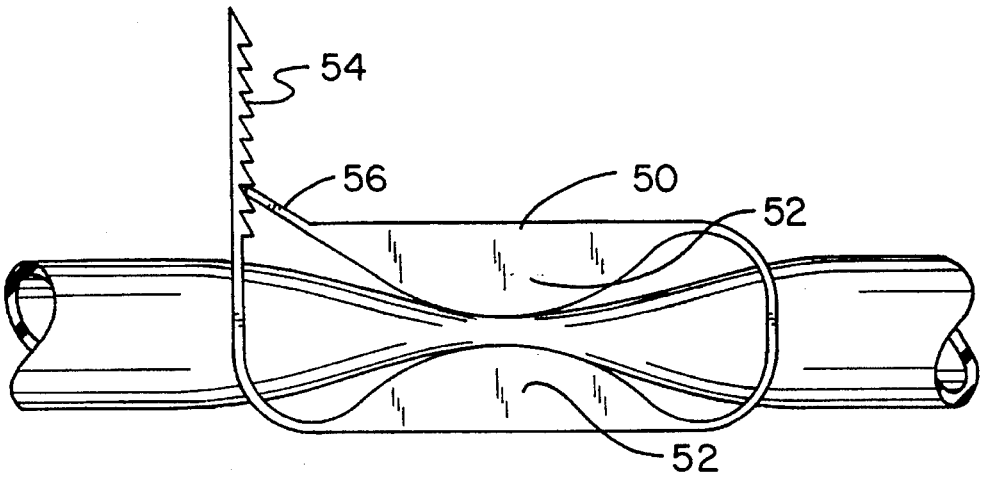
FIG. 7 is a side-elevational view of the present invention with the clamp secured to the water tube in a closed configuration.

With reference now to the drawings, and in particular, to FIG. 1 thereof, the preferred embodiment of the new and improved boy's urinal trainer for a toilet embodying the principles and concepts of the present invention and generally designated by the reference number 10 will be described.

Specifically, the present invention essentially includes three major components. The major components are the seat, tube, and clamp. These components are interrelated to provide the intended function.

More specifically, it will be noted in the various Figures that the first major component is the seat 12. The seat is tubular in structure. It is formed of a rigid plastic material. The seat has a top end 14 with an inwardly extended brim 16 formed thereon. The seat also has a bottom end 18 with an outwardly extended and curved radial lip 20 formed thereon. A peripheral vertical side wall 22 interconnects the top end with the bottom end to form the tubular structure. The seat also includes an annular rim 24 integrally coupled to the bottom end and extended downwards therefrom. The radial extent of the rim is less than that of the lip. The seat also includes a U-shaped cutout 26. The cutout is formed through the side wall and brim. The seat also includes a generally U-shaped channel 28 formed within the brim. The channel is extended from a location near one side of the cutout to an opposite location on the other side of the cutout. A plurality of outlets 30 are extended downwards from the channel. Each outlet is terminated at an opening near the side wall. The lip is positionable upon a top edge 32 of a bowl 34 of a toilet with the rim extended therein for holding the seat in a fixed configuration thereupon. The cutout is positionable near the front of the toilet bowl for receiving a boy's urine stream directed towards the bowl. The side wall in combination with the rim is used for containing a boy's urine stream as well as properly directing the boy's urine stream downwards to the bowl of the toilet for collection and subsequent removal through an attached sewage system.

The second major component is the tube 40. The tube is formed of a plastic material and is flexible in structure. The tube has a first end 42 extended through the brim 16 and positioned in the channel 26 for communication therewith. The tube has a second end 44 adapted to be connected to a water line of a toilet. The tube is adapted for delivering water to the channel for allowing rinsing of the side wall through the outlets when the toilet is flushed.

The third major component is the clamp 50. The clamp is coupled to the tube 40. The clamp has two opposed grips 52. A jagged flashing 54 extended from one grip and is adjustably mateable with a tongue 56 formed on the other grip. The clamp has one orientation for preventing water from being delivered to the seat when the grips are pushed together to pinch the tube and then secured with the tongue and flashing. The clamp also has another orientation when the tongue is released from the flashing for allowing the delivery of water to the seat.

The present invention is a toilet training device for small boys that is inserted into a bowl of a toilet to help them when urinating. The present invention is useful because it prevents a boy's urine stream from missing the inside of a bowl of a toilet and thereby falling to a floor below. If a boy's aim is slightly off center, the present invention ensures the urine stream is funneled into the toilet and not onto the floor. The present invention is made of plastic molded into a tubular sheet with U-shaped cut out formed its top. The curved cutout is formed through the side wall of the present invention and is shaped much like that of a urinal. When secured to a bowl of a toilet, the present invention extends upwards therefrom about two feet. A recessed rim on the bottom of the present invention is extended into the bowl of a toilet. A lip is seated on the edge of the toilet bowl. A ¼ inch diameter plastic tube, which is connected inside the toilet to the water line, runs to the overflow pipe in a toilet's tank and to a molded brim or insert at the top of the trainer. The brim is perforated for enabling water to rinse the seat when the toilet is flushed. Since the present invention can be rinsed, it stays relatively clean. The present invention could also be formed with a plastic tray in which the unit could be stored when not in use. This tray would also require the incorporation of a valve or clamp on the water line so that when the trainer is not in use, flushing the toilet wouldn't dispense water all over the floor.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A boy's urinal trainer for a toilet comprising, in combination:

a tubular plastic seat having a top end with an inwardly extended brim formed thereon, a bottom end with an outwardly extended and curved radial lip formed thereon, a peripheral vertical side wall interconnecting the top end with the bottom end and with a portion of the side wall having a length of about 2 feet as measured vertically between the lip and the top end, an annular integral rim extended downwards from the bottom end, a U-shaped cut out formed through the side wall and brim, a generally U-shaped channel formed within the brim and extended from a location near one side of the cut out to an opposite location on the other side of the cut out, and a plurality of outlets extended downwards from the channel with each outlet terminated at an opening near the side wall and with the lip positionable upon a top edge of a bowl of a toilet with the rim extended therein for holding the seat in a fixed configuration, the cut out receiving a boy's urine stream directed towards the bowl, and the side wall in combination with the rim used for properly directing a boy's urine downwards to the bowl for collection;

a flexible plastic tube with an inner diametric extent of about ¼ inch having a first end extended through the brim and positioned in the channel for communication therewith and a second end adapted to be connected to a water line of a toilet with the tube adapted for delivering water to the channel for allowing rinsing of the side wall through the outlets when the toilet is flushed; and a clamp coupled to the tube and having one orientation for preventing water from being delivered to the seat and another orientation for allowing such delivery to occur.

* * * * *